US009701909B2

(12) United States Patent
Stauffer, II

(10) Patent No.: US 9,701,909 B2
(45) **Date of Patent: *Jul. 11, 2017**

(54) EXTRACTION OF BITUMEN FROM OIL SANDS

(71) Applicant: John E. Stauffer, II, Greenwich, CT (US)

(72) Inventor: John E. Stauffer, II, Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/727,825

(22) Filed: Dec. 27, 2012

(65) Prior Publication Data

US 2017/0088779 A1 Mar. 30, 2017

Related U.S. Application Data

(63) Continuation-in-part of application No. 13/306,363, filed on Nov. 29, 2011, now Pat. No. 9,169,441, which is a continuation of application No. 12/260,313, filed on Oct. 29, 2008, now abandoned.

(51) Int. Cl.

| | |
|---|---|
| ***C10G 1/04*** | (2006.01) |
| ***C10G 1/00*** | (2006.01) |
| ***C10G 7/00*** | (2006.01) |
| ***C10G 45/08*** | (2006.01) |

(52) U.S. Cl.

CPC ..... *C10G 1/002* (2013.01); *C10G 1/045* (2013.01); *C10G 7/00* (2013.01); *C10G 45/08* (2013.01); *C10G 2300/202* (2013.01)

(58) Field of Classification Search

CPC ..... C10G 1/04–1/047
USPC ..... 208/390, 391
See application file for complete search history.

(56) References Cited

U.S. PATENT DOCUMENTS 5,837,130 A * 11/1998 Crossland ..... C10G 65/00 208/204
9,169,441 B2 * 10/2015 Stauffer ..... C10G 1/002

* cited by examiner

*Primary Examiner* — Michelle Stein
(74) *Attorney, Agent, or Firm* — Young Basile Hanlon & MacFarlane, P.C.

(57) ABSTRACT

Carbon dioxide is used as a solvent to extract bitumen from oil sands in an anhydrous process that is compatible with existing procedures for upgrading bitumen. The process should provide high yields and meet environmental concerns.

9 Claims, 2 Drawing Sheets

EXTRACTION OF BITUMEN FROM OIL SANDS

CROSS-REFERENCE TO RELATED APPLICATIONS

This application is a continuation-in-part of the co-pending U.S. patent application Ser. No. 13/306,363 filed Nov. 29, 2011, which in turn is a continuation of U.S. patent application serial No. 12/260,313 filed Oct. 29, 2008.

FIELD OF THE INVENTION

A process is provided for the extraction of bitumen from oil sands employing carbon disulfide as a solvent. In the process, oil sands are contacted with carbon disulfide to dissolve the hydrocarbon contained in the sands. Next, solids are separated from the solution. Finally, the resulting solution is simultaneously fractionated and hydrotreated in a heated, packed column to produce crude oils.

BACKGROUND OF THE INVENTION

Oil sands are growing in importance as a source of petroleum. Oil sands are found in various parts of the globe, but the most significant deposits occur in northern Alberta, Canada, along the Athabasca River. The composition of oil sans in a mixture of quartz, clay, water and about ten percent heavy oil with a consistency of tar and known in the industry as bitumen.

The accepted practice for extracting bitumen from oil sands is to mix the sands with hot water and caustic to form an oil emulsion that is siphoned off from the solids. The mineral tailings are discarded after about 95 percent of the oil has been recovered. The extracted oil is upgraded by one of two processes to produce a synthetic crude oil that is suitable for refining at a later stage.

While current technology is workable, it has some drawbacks, particularly as practiced on a large scale. Water pollution is caused by the discharge of substantial quantities of wastewater. The energy efficiency of the process is poor. Lastly, the required investment in plant and equipment is considerable.

Because of the shortcomings of present technology, there is a need for an improved process. The process must be cost-effective, meet environmental concerns and provide a product of the highest quality. These objects, as well as other features and advantages of the present invention, will be apparent from the following description and the figure that is included.

SUMMARY OF THE INVENTION

The present invention comprises three steps for the extraction of bitumen from oil sands. First, the oil sands are mixed with carbon disulfide to produce a carbon disulfide/bitumen solution. Second, solids are extracted from the solution. Finally, the solution is simultaneously fractionated and treated with hydrogen in a packed distillation column to produce crude oil.

The process is carried out for the most part under anhydrous conditions. In this manner, water pollution from the discharge of tailings is avoided. Additionally, the recovery of oil is enhanced. Finally, by recycling carbon disulfide to the extraction steps, its consumption is kept to a minimum.

In a preferred embodiment of the present invention, fractionation and hydrotreating are achieved in a unified operation using a heated distillation column acting simultaneously as a catalytic reactor.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE PROCESS

Figure 1:
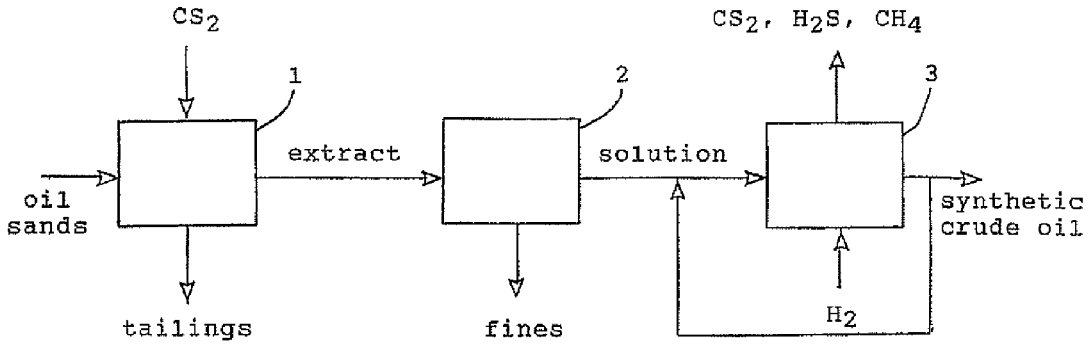
FIG. 1 is a block diagram showing the three steps of the process, including extraction, fractionation, and hydrotreating.

The oil contained in oil sands is a heavy, viscous hydrocarbon mixture not unlike tar. With the nomenclature of bitumen, this oil contains molecules with 20 or more carbon atoms. By contrast, light sweet crude, the premium feed to refineries, is mostly made up of compounds with 5 to 20 carbon atoms. Bitumen is further characterized by its content of aromatic compounds in addition to aliphatic hydrocarbons. Bitumen also contains substantial quantities of bound sulfur.

Given the nature of bitumen, this raw material presents difficult problems in its recovery from oil sands. As already mentioned, the prior art depends on forming a water-oil suspension that is separated from the solids by flotation. Alternatively, bitumen can be heated to a high temperature, in excess of 538° C., to reduce its viscosity to a point where it will flow. This approach is used for "in-situ" recovery of oil from oil sands that lie too deep in the ground to be dug up by strip-mining.

Faced with the drawbacks of current technology, the present invention seeks to improve both the efficiency and effectiveness of bitumen extraction. Thus, carbon disulfide is used as a solvent for bitumen. Carbon disulfide is an excellent solvent: it is completely miscible with hexane as well as xylene. Up to 20 gm. of paraffin wax and as much as 40 gm. of naphthalene can be dissolved in 100 gm. of carbon disulfide at 20° C.

The low viscosity of carbon disulfide is also an advantage. At 20° C., its viscosity is 0.32 centipoises. This value compares with about 10,000 centipoises and up for bitumen. The viscosities of solutions can be determined by experiment or calculated from standard formulas. Further enhancing its ability to extract bitumen, carbon disulfide can be employed in countercurrent equipment.

The cost of carbon disulfide is a major concern even though the reuse of solvent is assumed. The quantity of oil sands mined requires that a solvent be cheap. Fortunately, carbon disulfide can be synthesized from plentiful materials that are found in the oil sands deposits. It can be produced in an electric furnace from elemental sulfur and petroleum coke. Alternatively, it can be formed from carbonyl sulfide, which in turn is made from sulfur dioxide and carbon monoxide.

The solution of bitumen in carbon disulfide must be fractionated to recover the bitumen. This step can easily be accomplished by distillation. Bitumen has a high boiling point whereas carbon disulfide boils at 46.25° C. under 1 atmosphere pressure. Notwithstanding the ease of separation, some residual carbon disulfide can be expected to remain in the bitumen.

Because of tightened specifications for petroleum products, including gasoline and diesel fuel, there is a need to reduce sulfur values to the utmost minimum. Such a requirement can be met through hydrotreating. This step entails the reaction of the bitumen stream with hydrogen at elevated temperatures, in the range of 200° C. to 400° C. A catalyst may be used. Compounds, including those of cobalt, molybdenum and nickel, have been found to be effective in this application.

The reaction that takes place when carbon disulfide is treated with hydrogen is shown by the following equation.

$$CS_2+4\ H_2 \rightarrow CH_4+2\ H_2S \qquad 1.$$

Where $CS_2$ is carbon disulfide, $H_2$ is hydrogen, $CH_4$ is methane, and $H_2S$ is hydrogen sulfide. The thermodynamics for this reaction is extremely favorable under operating conditions so that it goes to completion.

The hydrotreating step can be integrated into the upgrading of bitumen. Because bitumen is so viscous, it cannot be pumped or processed in its existing state. Therefore, one of two processes is generally employed to reduce its viscosity: coking and hydrotreating. Sometimes both measures are taken. The result is a synthetic crude oil that is acceptable for further processing.

A better understanding of the present invention can be gained by referral to FIG. 1. Oil sands and carbon disulfide are fed to Extractor 1. After the tailings are removed, the extract is passed to filter 2 where fines are separated. The resulting solution is hydrotreated and fractionated in column 3 to produce synthetic crude oil.

Figure 2:
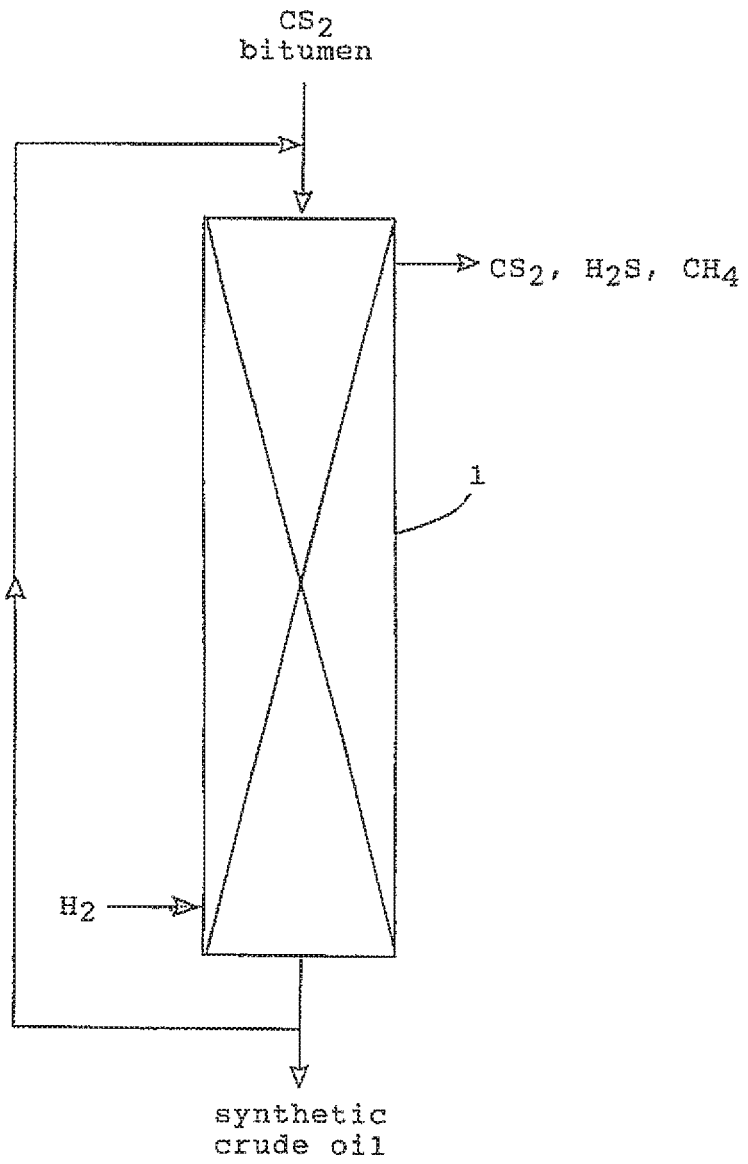
FIG. 2 is a schematic of a packed distillation column/catalytic reactor used for fractionation and hydrotreating.

As shown in FIG. 2, fractionation and hydrotreating are integrated into a single step. This procedure takes advantage of the lower viscosity of the carbon disulfide solution of bitumen.

Packed column 1 serves both as a distillation column and as a catalytic reactor for hydrotreating. The column packing comprises the active catalyst, for example, cobalt-molybdenum oxide deposited on a catalyst support such as alumina or silica-alumina.

During the operation of the process, bitumen solution is introduced at the top of the column and trickles down over the packing as hydrogen gas flows upward. A reboiler (not shown) heats the column bottoms while exit gases including hydrogen, hydrogen sulfide, methane and carbon disulfide are taken off the top of the column. Part of the synthetic crude oil product is recycled to the top of the column as a means of adjusting the solution viscosity.

The packed column has dual functions. As solution passes down the column, carbon disulfide is stripped from this stream. At the same time, hydrotreating takes place thereby converting the viscous bitumen into synthetic crude oil. Near the bottom of the column traces of carbon disulfide in the synthetic crude oil are further reduced as shown by equation 1. The result is a product that meets specifications for viscosity, purity and other attributes.

EXAMPLE

The viscosity of a solution of bitumen in carbon disulfide was calculated using the following expression:

$$\text{Log}\ \Phi = x_A \log \Phi_A\ x_B \log \Phi_B$$

where $\Phi$ is fluidity, the reciprocal of the coefficient of viscosity, and x is the mole fraction.

For a solution in which the mole fraction of bitumen is 0.1, the viscosity equals 0.90 centipoises. This result compares with the viscosity of 1.0 centipoises for water.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A process for the production of synthetic crude oil from bitumen comprising the steps of:
- contacting oil sands with carbon disulfide to produce a dissolved bitumen solution;
- separating solids from the dissolved bitumen solution; and
- fractionating and hydrotreating the solution as a unified operation in a packed column to produce synthetic crude oil.

2. A process according to claim 1 wherein the packed column contains a catalyst.

3. A process according to claim 2 wherein the catalyst is selected from the group consisting of cobalt, nickel and molybdenum.

4. A process according to claim 1 wherein the fractionating and hydrotreating step is carried out at a temperature in the range of 200° C. to 400° C.

5. A process according to claim 1 wherein hydrotreating removes traces of carbon disulfide from the synthetic crude oil by reacting the carbon disulfide with hydrogen to produce methane and hydrogen sulfide.

6. A process according to claim 1 wherein a portion of the synthetic crude oil produced is recycled to the packed column.

7. A process for the production of synthetic crude oil from bitumen comprising the steps of:
- contacting oil sands with carbon disulfide to produce a dissolved bitumen solution;
- separating solids from the dissolved bitumen solution;
- introducing the dissolved bitumen solution into the top of a heated distillation column containing a catalyst while simultaneously causing hydrogen to flow upwardly through the column.

8. The process of claim 7 wherein the step of introducing the dissolved bitumen solution into the top of a heated distillation column is carried out at a temperature in the range of 200° C. to 400° C.

9. The process of claim 7 wherein the column contains a catalyst selected from the group consisting of cobalt, nickel and molybdenum.

* * * * *